US007677559B2

(12) United States Patent
Müller

(10) Patent No.: US 7,677,559 B2
(45) Date of Patent: Mar. 16, 2010

(54) APPARATUS FOR LATERALLY ALIGNING PRINTED PRODUCTS

(75) Inventor: Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 59 days.

(21) Appl. No.: 11/970,948

(22) Filed: Jan. 8, 2008

(65) Prior Publication Data

US 2008/0211172 A1 Sep. 4, 2008

(30) Foreign Application Priority Data

Jan. 12, 2007 (CH) ..... 0037/07

(51) Int. Cl.
*B65H 9/00* (2006.01)

(52) U.S. Cl. ..... 271/237; 271/238; 271/240; 271/188; 271/280; 198/462.3

(58) Field of Classification Search ..... 271/237, 271/238, 240, 188, 280
See application file for complete search history.

(56) References Cited

U.S. PATENT DOCUMENTS

| | | | | |
|---|---|---|---|---|
| 4,015,843 | A | 4/1977 | Tennant | |
| 4,381,108 | A | 4/1983 | Newsome | |
| 4,955,964 | A | 9/1990 | Hain | |
| 5,158,278 | A * | 10/1992 | Auf der Mauer | 271/270 |
| 2005/0006838 | A1 | 1/2005 | Liebheit | |

FOREIGN PATENT DOCUMENTS

| | | | |
|---|---|---|---|
| DE | 31 13 399 | A1 | 10/1982 |
| DE | 32 21 601 | A1 | 3/1983 |
| EP | 0 223 941 | A1 | 6/1987 |
| EP | 0 356 150 | A1 | 2/1990 |
| EP | 0 567 807 | A1 | 11/1993 |
| JP | 2-291334 | A | 12/1990 |
| JP | 2000-351479 | A | 12/2000 |
| WO | WO 02/49945 | A2 | 6/2002 |

* cited by examiner

*Primary Examiner*—Patrick H Mackey
*Assistant Examiner*—Luis Gonzalez
(74) *Attorney, Agent, or Firm*—Alston & Bird, LLP

(57) ABSTRACT

The apparatus 10 has a conveyor 12 which may be configured as a multiple tape conveyor and the working section 14 of which, which is driven in a conveying direction (F), forms a supporting face 16 for the printed products 18 which accumulate in an overlapping formation (S). An aligning plate 66 is situated on each side of the conveyor 12. The working section 14 of the conveyor can be deflected out of a conveying plane by means of a switching means 34, in order, in particular for the aligning of thin printed products 18 with few pages, to form a bend 62 in the products which reinforces them transversely with respect to the conveying direction (F) so that they can be laterally shifted into alignment by the aligning plates without damage.

8 Claims, 2 Drawing Sheets

APPARATUS FOR LATERALLY ALIGNING PRINTED PRODUCTS

BACKGROUND OF THE INVENTION

The present invention relates to an apparatus for laterally aligning accumulating flexible, flat objects, such as printed products, while the objects are being transported on a conveyor.

An apparatus of this type is known, for example, from EP 0 223 941 A. For laterally aligning printed products which are situated on a conveyor which is configured as a belt conveyor, said apparatus has guide rails in the form of endless toothed belts which are arranged on both sides of the conveyor and are moved by motor-driven pulley wheels in the same movement direction and at approximately the same conveying speed as the printed products.

A further apparatus for laterally aligning printed products which accumulate in an overlapping formation according to EP 0 567 807 A has a row of aligning columns as aligning unit. Said aligning columns have a round outline and are driven in such a way that their surface which is oriented toward the overlapping formation moves at conveying speed in the conveying direction F. In order to prevent printed products which are conveyed, for example, between two aligning columns with one corner against a spacing being carried between the aligning columns through and below the transport belt, in which case they could endanger the overlapped stream and the latter could be damaged, stop plates are provided between the aligning columns.

Apparatuses of this type function satisfactorily if the accumulating printed products have a certain thickness and therefore a sufficient inherent stability. However, there can be problems if, for example, thin printed products, that is to say having few sheets, predominantly in the tabloid format, accumulate with a great ejection rate from a rotary printing press, the inherent stability of said printed sheets being insufficient for the known lateral aligning.

It is therefore an object of the present invention to provide an apparatus of the generic type, by means of which flexible, flat objects having varying inherent stability can be aligned laterally.

SUMMARY OF THE INVENTION

The above and other objects and advantages of the present invention are achieved by the provision of a conveyor having a working section which is driven in a conveying direction, and at least one aligning unit arranged adjacent a side of the working section of the conveyor. Switching means are associated with the conveyor, whereby the working section runs at least approximately in a plane in a rest position of the switching means. In a working position of the switching means, the working section is deflected out of the above mentioned plane in such a way that a bend is formed in the flexible, flat objects, which reinforces them transversely with respect to the conveying direction.

In order to align relatively thick objects, such as printed products which have a large number of sheets and therefore have a sufficient rigidity, the working section can run in the plane, while it is deflected for aligning thin printed products which have a low number of sheets. As a result of the bend which is formed in the printed products in the process, they can be aligned by the laterally acting forces of the aligning unit, without there being the danger of creasing or damaging the printed products, or having the products detached from the overlapping formation.

BRIEF DESCRIPTION OF THE DRAWINGS

The invention will be explained using embodiments which are shown in the drawing, in which, purely diagrammatically.

DETAILED DESCRIPTION OF THE PREFERRED EMBODIMENTS

Figure 1:
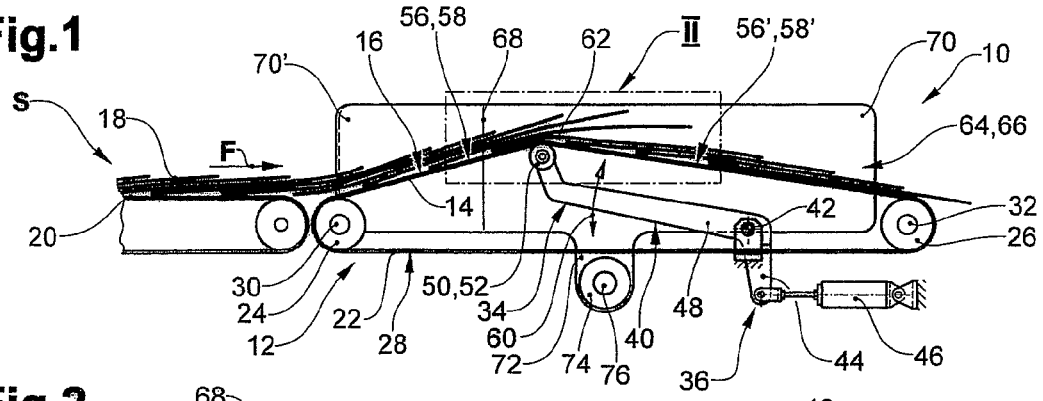
FIG. 1 shows, in a side view, an apparatus according to the invention having switching means which are situated in the working position, as a result of which a working section of a conveyor is deflected, in order to form a bend in the printed products which are to be aligned laterally which reinforces them transversely with respect to the conveying direction.

The embodiment which is shown in FIGS. 1 to 4 of an apparatus 10 according to the invention has a conveyor 12 which is configured as a belt conveyor and the upper working section 14 of which, which is driven in the conveying direction (F), forms a supporting face 16 for printed products 18. The printed products 18 rest freely on the supporting face 16. The printed products 18 accumulate in an overlapping formation (S) and are fed to the conveyor 12 in the conveying direction (F) by means of a feed conveyor 20 which is likewise configured as a belt conveyor.

Figure 4:
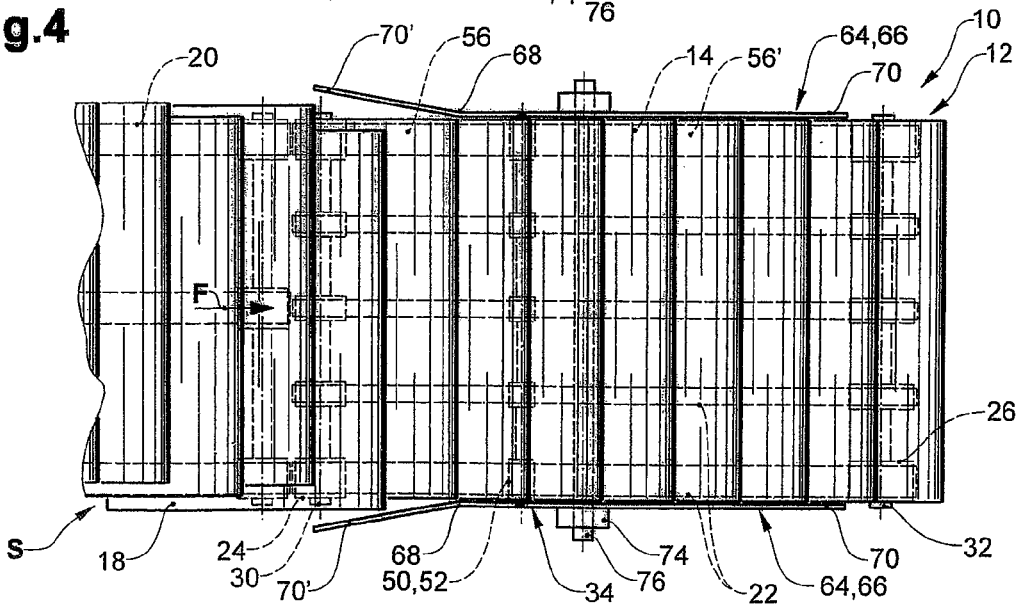
FIG. 4 shows, in plan view, the apparatus according to FIGS. 1 to 3.

As can be gathered, in particular, from FIG. 4, the conveyor 12 has a plurality of, five in the present case, tapes 22 which run parallel to one another, form the belt of the belt conveyor and are guided around roll-like deflecting rollers 24 at the upstream end of the conveyor 12, adjacent to the feed conveyor 20, and around roll-like drive rollers 26 at the downstream end of the conveyor 12. The lower return run 28 runs rectilinearly between the drive rollers 26 and deflecting rollers 24. The deflecting rollers 24 are seated freely rotatably on a common bearing axle 30, while the drive rollers 26 are seated fixedly on a common drive shaft 32 which is driven by motor.

Figure 2:
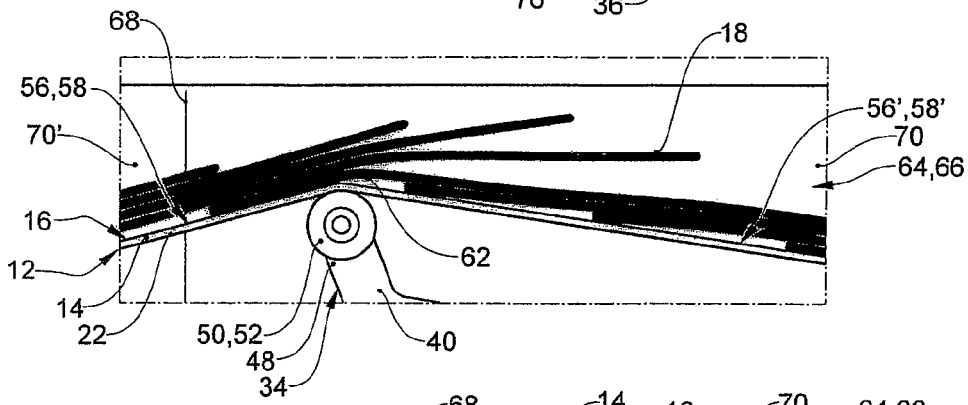
FIG. 2 shows, on an enlarged scale in comparison with FIG. 1, a detail which is labeled there by II.
Figure 3:
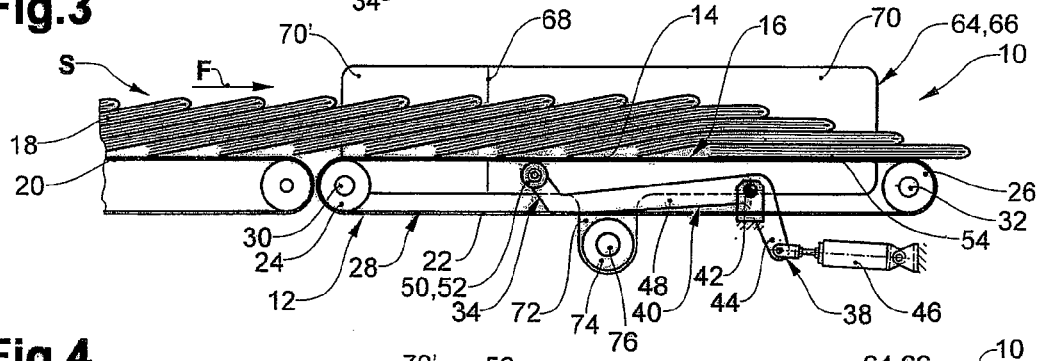
FIG. 3 shows, likewise in a side view, the apparatus according to FIGS. 1 and 2, but with switching means which are situated in the rest position and a working section which runs in a plane.

The conveyor 12 is assigned switching means 34 which are shown in their working position 36 in FIGS. 1 and 2 and in the rest position 38 in FIG. 3. The switching means 34 have an angled lever pair, of which only one angled lever 40 is shown for reasons of improved clarity. The angled levers 40 which are arranged between in each case adjacent tapes 22 are mounted such that they can pivot about a pivoting axle 42 which extends at right angles to the conveying direction F and parallel to the working section 14. Below the return run 28, a drive-side lever arm 44 is articulated on a drive assembly 46 which is configured as a piston/cylinder assembly and is secondly fastened to a machine frame (not shown in greater detail), like the bearing blocks for the pivoting axle 42. An output-side lever arm 48 of the angled lever 40 extends approximately in the longitudinal direction of the conveyor 12 and, at its free end, carries deflecting rolls 52 which are mounted so as to rotate freely and act as deflecting elements 50.

If the switching means 34 are situated in the rest position 38 (see FIG. 3), the working section 14 runs rectilinearly in the horizontal direction between the deflecting roller 24 and the drive roller 26 over the deflecting rolls 52 which support it, and forms a conveying plane 54.

If the switching means 34 are situated in the working position 36 (see FIGS. 1 and 2), the continuous working section 14 is deflected concavely out of the conveying plane 54 in the upward direction, in such a way that, as seen in a side view, the supporting face 16 is deflected in the manner of a gable roof, the gable resulting from the deflection of the working section 14 about the deflecting rolls 52 which are configured with a considerably smaller diameter than the deflecting rollers 24 and drive rollers 26. A first run section 56 of the working section 14 is therefore formed between the deflecting rollers 24 and the deflecting rolls 52, having a flat first supporting face section 58 which has an upward slope as viewed in the conveying direction F, and a second run section 56' is formed between the deflecting rolls 52 and the drive rollers 26, having a flat second supporting face section 58' which has a downward slope as viewed in the conveying direction. The two supporting face sections 58, 58' enclose an angle of approximately 200°.

As indicated by the double arrow 60, it is conceivable to select the deflection of the working section 14 and therefore the abovementioned angle to be smaller or greater depending on the quality of the printed products 18 which are to be aligned.

The deflecting elements 50 therefore form approximately a creasing line which extends at right angles to the conveying direction F between the run sections 56 and 56' which follow one another.

As can be gathered, in particular, from FIG. 2, the course of the working section 14, when the switching means 34 are situated in the working position 36, forms a bend 62 in the printed products 18, at the transition from the first run section 56 to the second run section 56', approximately in the center of the conveyor 12, which bend 62 has a bending line which runs at least approximately at right angles to the conveying direction F. This results in a reinforcement of the printed products 18 in such a way that they can absorb the aligning forces which act on them transversely, in particular at right angles, with respect to the conveying direction F without being damaged and creased. Furthermore, printed products 18 which follow one another in the overlapping formation S are fanned out at the transition from the first run section 56 to the second run section 56' or from the first supporting face section 58 to the second supporting face section 58'. This reduces the friction between the printed products 18 which follow one another, which in turn reduces the aligning forces which act on the printed products 18.

In each case one aligning unit 64 is arranged on both sides of the conveyor 12. Each of the aligning units 64 has an aligning plate 66 which is bent away to the outside about a vertical bending line 68 at a spacing upstream of the deflecting element 50, that is to say of the deflecting rolls 52. As viewed in the conveying direction F, the two aligning plates 66 extend approximately over the entire length of the conveyor 12, the two flat sections 70 which are situated downstream of the bending line 68 being oriented parallel to one another and in the conveying direction F, extending at right angles to the supporting face 16 and being arranged at right angles to the conveying direction F at a spacing which corresponds approximately to the width of the printed products 18. Those sections 70' of the aligning plates 66 which are situated upstream of the bending line 68 form an inlet which narrows in a wedge-shaped manner for the accumulating printed products 18.

The bending line 68 can be situated at the deflecting element 50; it is advantageously arranged upstream with regard to the former at a spacing which is, however, substantially smaller than the length of the printed products which is measured in the conveying direction F, for example from 10 to 20% of this length.

As seen in a side view, the two aligning plates 66 are of rectangular configuration, their lower edge being situated below the working section 14 and their upper edge always being situated above the working section 14, as measured in the vertical direction. As viewed in the conveying direction F, a holding tongue 72 which is seated in each case on a running nut 74 extends downward from the aligning plates 66 approximately centrally with respect to the latter. The running nuts 74 are mounted on a spindle 76 which can be rotated in order to adapt the spacing of the aligning plates 66 to the width of the printed products 18 which are to be processed. The threaded sections of the spindle 76 which are assigned to the two running nuts 74 are configured to run in opposite directions for this purpose.

The apparatus 10 which is shown in FIGS. 1 to 4 functions as follows:

The printed products 18 are fed by means of the feed conveyor 20 in an overlapping formation S, in which printed products 18 which follow one another can be offset obliquely or, as can be gathered, in particular, from FIG. 4 using the printed products which are situated upstream of the bending line 68, laterally. If the printed products are stable, relatively thick printed products with a large number of sheets, as shown, for example, in FIG. 3, the switching means 34 can be situated in the rest position 38. The printed products 18 which are fed to the supporting face 16 of the conveyor 12, which supporting face 16 is flat in this case, are conveyed by means of the conveyor 12 through the aligning gap which is formed by the two aligning plates 66, the sections 70' of the aligning plates 66 firstly centering the printed products 18 and the sections 70 secondly aligning the printed products 18 in such a way that their side edges run in the conveying direction F and are arranged in a straight line.

If, however, accumulating printed products 18 are to be processed which have an insufficient inherent stability for aligning on a flat conveyor, the switching means 34 are moved into their working position 36. In precisely the same way as described further above, the printed products 18 are centered and aligned laterally during their transportation through the aligning gap, the printed products 18, however, then being reinforced by a bend being formed in them, as a consequence of the guidance of the working section 14. Moreover, the fanning out of the overlapping formation S at the deflecting element 50 reduces the aligning.

In the embodiment which is shown in FIGS. 1 to 4 having single-piece tapes 22 which are closed in themselves, a length compensation means can be provided in the region of the return run 28. However, it is also conceivable to configure the tapes 22 from an elastic material, with the result that they can absorb the change in length during the switching of the switching means 34.

Figure 5:
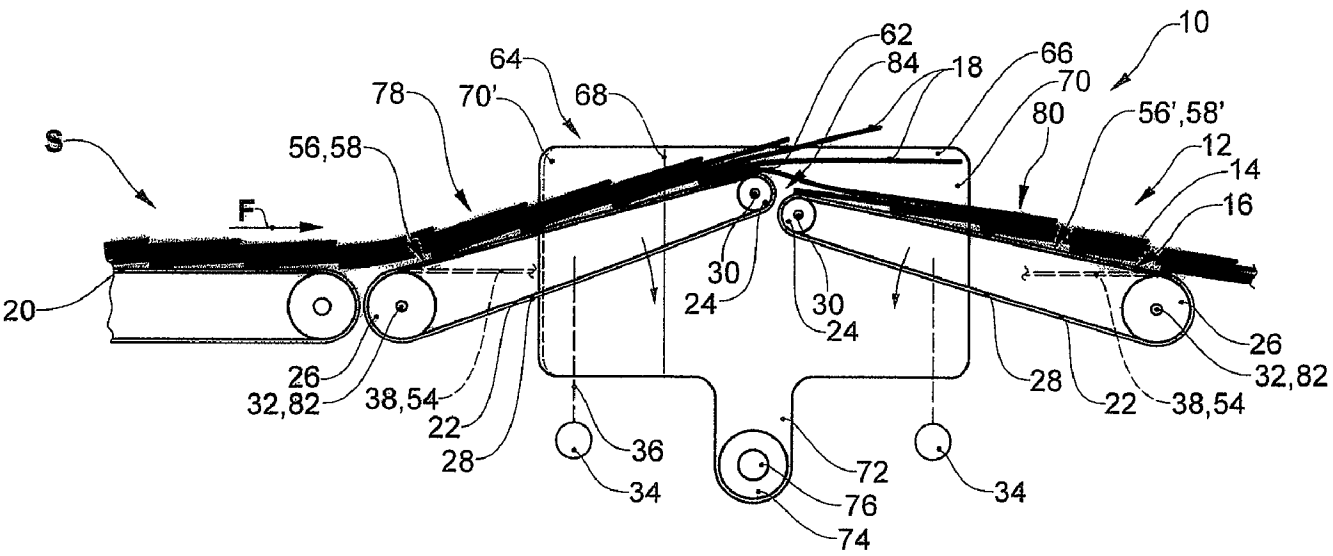
FIG. 5 shows, in a side view, a second embodiment of the apparatus according to the invention having two tipper conveyors which are arranged behind one another, with switching means which are situated in the working position, the two tipper conveyors forming a step which falls away in addition to a creaselike bend in the conveying path.
Figure 6:
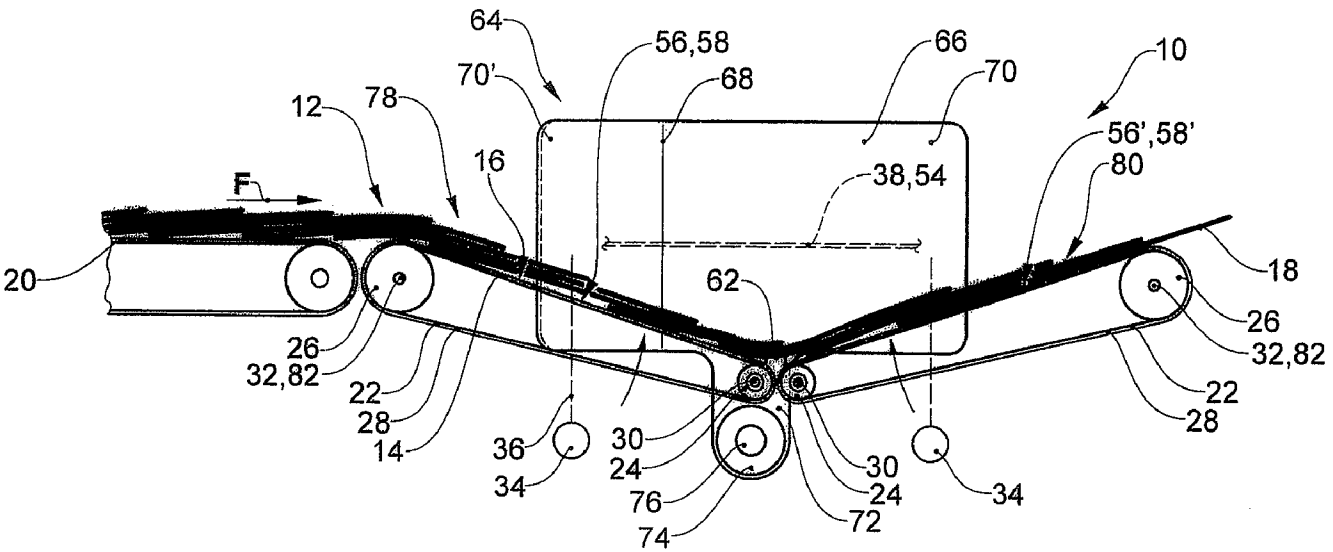
FIG. 6 shows, in the same illustration as in FIG. 5, a further embodiment of the apparatus according to the invention having two tipper conveyors, the latter forming a V-shaped conveying path, as seen in a side view, with switching means which are situated in the working position.

While the working section 14 is of continuous configuration in the embodiment which is shown in FIGS. 1 to 4 of the apparatus according to the invention, it can be formed by two tipper conveyors 78 which follow one another in the conveying direction F and are arranged behind one another, as shown by FIGS. 5 and 6. In the description of these embodiments, the same designations are used for identically acting parts as in the description of the embodiment according to FIGS. 1 to 4. Furthermore, only the differences will be explained in the following text.

The tipper conveyors 78, 80 are likewise configured as tape conveyors and are mounted at their ends which face away from one another such that they can pivot about the tipper axles 82. The tapes 22 of the first tipper conveyor 78 are guided around drive rollers 26 which are seated on a drive shaft 32 which is coaxial with respect to the relevant tipper axle 82. At that end of the first tipper conveyor 78 which lies downstream and faces the second tipper conveyor 80, the tapes 22 are guided around the deflecting rollers 24 which are seated in a freely rotatable manner on a bearing axle 30 which for its part is fastened to lateral plates (not shown) which can be pivoted around the associated tipper axle 82 by means of the diagrammatically indicated switching means 34, for example a cylinder/piston assembly. The active run of the first tipper conveyor 78 forms the first run section 56 and therefore the first supporting face section 58 of the conveyor 12. For the sake of completeness, it is to be mentioned that the first tipper conveyor 78 is arranged so as to follow the feed conveyor 20, as viewed in the conveying direction F.

The second tipper conveyor 80 which follows downstream from the first tipper conveyor 78, as viewed in the conveying direction F, is configured in precisely the same way as the latter, but is arranged in a mirror-symmetrical manner with respect to it. At the downstream end of the second tipper conveyor 80, the tapes 22 are guided around drive rollers 26 which are seated fixedly in terms of rotation on the drive shaft 32 which is coaxial with respect to the associated tipper axle 82. At the upstream end which faces the first tipper conveyor 78, the tapes 22 are guided around deflecting rollers 24 which are seated in a freely rotatable manner on the bearing axle 30. This in turn is fastened to plates (not shown) which can likewise be pivoted about the tipper axle 82 by means of switching means 34. The active run of the second tipper conveyor 80 forms the second run section 56' of the working section 14 and the second supporting face section 58' of the supporting face 16. The two tipper conveyors 78, 80 are driven in the conveying direction F at the same speed as the feed conveyor 20. For the sake of completeness, it is to be mentioned that those ends of the tipper conveyors 78, 80 which face one another are at only a small spacing from one another.

In each case one aligning plate 66 of the aligning units 64 extends on both sides centrally between the two tipper axles 82. Said aligning plates 66 are of identical configuration as described further above in conjunction with FIGS. 1 to 4.

If the switching means 34 are situated in the rest position, the two run sections 56, 56' of the tipper conveyors 78 and 80 lie in a horizontal conveying plane 54 which is indicated by a dashed line in FIGS. 5 and 6. In this rest position 38, relatively thick printed products with a large number of sheets which accumulate in the overlapping formation S can be aligned laterally, as is explained further above in conjunction with FIG. 3. If printed products 18 having a relatively low inherent stability accumulate, the switching means 34 are moved into the working position 36, with the result that the tipper conveyors form a convex supporting face 16 according to FIG. 5. The aligning then takes place in the same way as described further above in conjunction with FIGS. 1 and 2.

In the embodiment which is shown in FIG. 5, it is conceivable to pivot the two tipper conveyors 78, 80 by means of the switching means 34 in such a way that their ends which face one another are situated at an identical level above the conveying plane 54. The effect achieved here of the reinforcement of the printed products by the formation of a bend 62 and the fanning out of the overlapping formation S is the same here as described further above in conjunction with FIGS. 1 and 2.

As shown in FIG. 5, it is advantageous, however, in this embodiment if, in the working position 36, the upstream end of the first tipper conveyor 78 is situated at a greater height above the conveying plane 54, as measured in the vertical direction, than the downstream end of the second tipper conveyor 80. Here, those two ends of the two tipper conveyors 78, 80 which face one another form a falling step 84 in the conveying direction F. This has the consequence that, in addition to the reinforcement of the printed products 18 by formation of a bend 62 and the fanning out of the overlapping formation S, a division takes place between the printed products 18 as soon as in each case one printed product 18 has left the region of action of the first tipper conveyor 78 and has been lowered by way of its trailing edge into contact with the second tipper conveyor 80. This reduces the friction conditions between the printed products 18 and, as a result, reduces the forces which act on the printed products 18 for lateral aligning.

The apparatus which is shown in FIG. 6 is of identical configuration as that according to FIG. 5, it then being possible, however, for the two tipper conveyors 78, 80 to be pivoted from the conveying plane 54, in which their run sections 56, 56' lie in the rest position 38 of the switching means 34, in the downward direction. The supporting face 16 extends concavely. As seen in a side view, the run sections 56, 56' and supporting face sections 58, 58' of the two tipper conveyors 78, 80 form a widely spread V and enclose an angle of approximately 140°.

In this case, the first supporting face section 58 of the conveyor 12 is provided in the conveying direction F with a downward slope and the second supporting face section 58' is provided with an upward slope. At the transition from the downward slope to the upward slope, that is to say at the transition from the first tipper conveyor 78 to the second tipper conveyor 80, the printed products 18 are again bent and reinforced in the transverse direction as a result; however, in this embodiment, fanning out of the printed products 18 which are conveyed in the overlapping formation S does not take place. Otherwise, the aligning takes place in the same way as described further above.

In all embodiments which are shown, the printed products 18 are fed in an overlapping formation S to the apparatus 10, in which each printed product 18 lies on the respectively preceding printed product 18 in an overlapping manner. However, it is also possible to align printed products 18, and therefore flexible, flat objects, which accumulate one after another without overlapping.

In order, in the embodiment according to FIG. 6, to prevent the printed products 18 being damaged or conveyed away out of the overlapping formation S in the downward direction by way of their leading edges in the gap between the first and second tipper conveyors 78, 80, it is conceivable to lower the first tipper conveyor 78 into the working position 36 to a less pronounced extent than the second tipper conveyor 80, with the result that once again a falling step, as viewed in the conveying direction F, is formed. However, it is also possible to configure one tipper conveyor 78, 80 with tongue-like supporting plates which bridge the gap between the two tipper conveyors 78, 80 and are arranged between the tapes 22.

Finally, it would also be conceivable to configure the two tipper conveyors 78, 80 in such a way that their ends overlap slightly.

It is conceivable to make the aligning plates 66 of the aligning units 64 vibrate. Furthermore, it is conceivable to provide a row of aligning columns instead of aligning plates 66 for each of the two aligning units 64, as are known from EP 0 567 807 A. Moreover, it is conceivable, instead of the aligning plates 66, to provide guide rails in the form of endless toothed belts which are moved by motor-driven pulley wheels in the conveying direction and approximately at conveying speed, as is known from EP 0 223 941 A. Here, the pulley wheels are advantageously mounted eccentrically and are driven synchronously in such a way that the toothed belts synchronously make a movement toward one another and away from one another at right angles to the conveying direction F.

It is also possible to provide a single aligning unit 64 on only one side of the conveyor 12. In this case, for example, the conveyor 12 can be arranged such that it is pivoted out of the horizontal around an axle which extends as viewed in the conveying direction F, in such a way that the aligning unit 64 is situated on the lower lying side of the conveyor 12. However, it is to be ensured here that the printed products come into contact with the aligning unit 64 either as a result of their inherent weight or that they are displaced there by displacing means.

It goes without saying that it is also conceivable to provide a chain conveyor instead of a belt or tape conveyor.

Furthermore, it is advantageous if the aligning plates 66 or aligning means which correspond to the former are situated close to the belt or the respectively outermost tapes 22 or chains. Here, the printed products 18 are supported close to their side edge, which additionally prevents creasing. If the apparatus 10 according to the invention can be set to formats of different width, as is explained in conjunction with FIG. 4, the conveyor 12 is advantageously configured in such a way that its tapes 22 or chains can likewise be displaced in the transverse direction of the conveyor 12, in order for it to be possible for the laterally outermost tapes 22 or chains to be kept close to the aligning plate 66 or corresponding aligning means independently of the width of the printed products.

In the embodiments which are shown, the working section 14 forms an at least approximately angular bend in the working position 36 of the switching means 34, the bending line extending at right angles to the conveying direction F. Correspondingly, the printed products 18 are also bent in a region which is virtually linear and has a small extent, as viewed in the conveying direction F. It would also be conceivable to configure the conveyor 12 in such a way that the supporting face 16 forms a bend having a relatively great radius.

The invention claimed is:

1. An apparatus for laterally aligning accumulating flexible, flat objects, such as printed products, comprising:

a conveyor having a working section which is driven in a conveying direction (F) and forms a supporting face for the objects received thereon, at least one aligning unit arranged adjacent the side of the working section of the conveyor, and switching means associated with the conveyor and which is selectively moveable between a rest position wherein the working section of the conveyor is substantially planar and a working position, wherein the working section is deflected out of the plane in such a manner that a bend is formed in the objects which reinforces them transversely with respect to the conveying direction (F), wherein the working section comprises two run sections which follow one another in the conveying direction (F), each of the run sections forming at least approximately a flat supporting face section, and when the switching means are situated in the working position, the supporting face sections are arranged at an angle with respect to one another, and wherein the two run sections are formed by two tipper conveyors which are arranged behind one another in the conveying direction (F), and the tipper conveyors are pivotable by means of the switching means about tipper axles in those end regions of the tipper conveyors which face away from one another.

2. The apparatus as claimed in claim 1, wherein the tipper conveyors are pivoted jointly by means of the switching means in such a way that their ends which face one another are situated at the same level.

3. The apparatus as claimed in claim 1, wherein, in the working position of the switching means, those ends of the tipper conveyors which face one another are situated above the other ends of the tipper conveyors.

4. The apparatus as claimed in claim 1, wherein, in the working position of the switching means, those ends of the tipper conveyors which face one another are situated below the other ends of the tipper conveyors.

5. The apparatus as claimed in claim 1, wherein the tipper conveyors are pivoted in such a way that, in the working position of the switching means, those ends which face one another form a step which falls away in the conveying direction (F).

6. The apparatus as claimed in claim 1, wherein the conveyor comprises several parallel endless tapes.

7. The apparatus as claimed in claim 1, wherein two of said aligning units are arranged on respective opposite sides of the conveyor.

8. The apparatus as claimed in claim 7 wherein the two aligning units are adjustable toward and away from each other.

* * * * *